US007374269B2

(12) United States Patent
Olson

(10) Patent No.: US 7,374,269 B2
(45) Date of Patent: May 20, 2008

(54) METHODS FOR DETERMINING UNIDIRECTIONAL PRINT DIRECTION FOR IMPROVED QUALITY

(75) Inventor: Stephen T. Olson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 305 days.

(21) Appl. No.: 10/956,927

(22) Filed: Sep. 30, 2004

(65) Prior Publication Data

US 2006/0066658 A1 Mar. 30, 2006

(51) Int. Cl.
*B41J 29/393* (2006.01)
*B41J 29/38* (2006.01)

(52) U.S. Cl. ..... 347/19; 347/14

(58) Field of Classification Search ..... 347/19
See application file for complete search history.

(56) References Cited

U.S. PATENT DOCUMENTS 5,534,895 A 7/1996 Lindenfelser et al.
5,600,350 A 2/1997 Cobbs et al.
5,644,344 A 7/1997 Haselby
5,661,507 A 8/1997 Sperry
5,796,414 A 8/1998 Sievert et al.
6,364,447 B1 4/2002 Boleda et al.
6,554,387 B1 4/2003 Otsuki
6,568,782 B1 5/2003 Haselby
6,594,028 B1 * 7/2003 Hamamoto et al. ..... 347/15
6,672,701 B1 * 1/2004 Nunokawa ..... 347/19
6,726,303 B2 4/2004 Otsuki
2005/0052494 A1 * 3/2005 Takahashi et al. ..... 347/41
2005/0253888 A1 * 11/2005 Fogarty et al. ..... 347/19

* cited by examiner

*Primary Examiner*—Matthew Luu
*Assistant Examiner*—Jannelle M Lebron
(74) *Attorney, Agent, or Firm*—Dinsmore & Shohl, LLP

(57) ABSTRACT

A method of determining unidirectional print direction for optimal quality on an ink jet printer capable of bidirectional printing includes printing a first plurality of indicators on a recordable medium, wherein the first plurality of indicators are printed in a first direction; printing a second plurality of indicators on the recordable medium, wherein the second plurality of indicators are printed in a second direction opposite the first direction; and determining an optimum print direction from the printed indicators; and setting in the printer the optimum print direction for unidirectional printing.

3 Claims, 4 Drawing Sheets

LEFT TO RIGHT CARRIER MOTION

RIGHT TO LEFT CARRIER MOTION

PRIOR ART

METHODS FOR DETERMINING UNIDIRECTIONAL PRINT DIRECTION FOR IMPROVED QUALITY

TECHNICAL FIELD

The present invention relates to ink jet printers and methods, and more particularly, to such methods and apparatus for determining optimal unidirectional print direction on printers capable of bidirectional printing.

BACKGROUND OF THE INVENTION

An ink jet printer is an non-impact printing device that forms characters and other images by ejecting ink drops in a controllable way from a printhead. Ink jet printing mechanisms may be used in different devices such as printers, plotters, facsimile machines, copiers and the like.

The printhead of an ink jet printer ejects ink through multiple nozzles in the form of miniscule drops which "fly" for a small space and then strike the print media. Typically, different printheads are used for different colors. Ink jet printers usually print within a range of 300 or 2400 or more dots per inch. The ink drops are dried upon the media soon after being deposited to form the desired printed image.

There are several types of ink jet printheads including, for example, thermal printheads and piezoelectric printheads. By way of example, in a thermal ink jet printhead, the ink drops are ejected from individual nozzles by localized heating. Each of the nozzles have a small heating element. Electric current is made to pass through the element to heat it. This causes a tiny volume of ink to be heated and vaporized instantaneously by the heating element. Upon being vaporized, the ink is ejected through the nozzle. Circuitry is connected to the individual heating elements to supply the energy and pulses and, in this manner, to deposit in a controlled way ink drops from associated individual nozzles. These circuits have communications with the imaging circuitry of the printer to activate selected nozzles of the printhead in order to form the desired images on the printing support.

Thermal ink jet printing is based on accurate ballistic delivery of small ink droplets to exact locations on the paper or other media. One key factor for sharp, high quality images stems from the accuracy of the droplet placement. Droplet placement inaccuracies are typically caused by imperfections and variations of the mechanical and geometrical characteristics of the printer and printhead. For example, the defects caused by droplet placement errors appear in a variety of ways and may depend on the printheads being used.

Ink jet printers commonly include a printhead which is mounted on a carriage assembly. The carriage assembly is moveable in a transverse direction, relative to an advance direction of a print medium such as paper. As the printhead is moved across the print medium during a particular pass of the carriage assembly, ink is selectively jetted from dot forming nozzles formed in the printhead and deposited on the print medium at corresponding ink dot placement locations in the image area of the print medium. Since the printhead moves in a direction transverse (e.g., perpendicular) to the advance direction of the print medium, each dot forming nozzle passes in a linear manner over the print medium. The line associated with each dot forming nozzle which overlays the print medium is commonly referred to as a raster or raster line. A plurality of rasters which extend across the image area of the print medium are disposed vertically adjacent to each other in the advance direction of the print medium.

Ink dot placement-related problems vary in severity with a large number of printer-related variables including desired printing speed, print head array configurations, transfer versus direct printing, aqueous versus phase changing, required printing resolution, direction of printing, print post processing, if any, and the type of medium. In particular, color ink jet printing requires careful placement of ink dots to meet current resolution and color fidelity requirements without producing undesired printing artifacts.

The field of ink jet printing is replete with references describing solutions to problems associated with placing ink dots on a print medium. In one known process, a subgroup, which is the same for all current positions at a print line, is formed for a partial number of dot forming nozzles. The dot forming nozzles of the subgroup are selectively controlled at every position according to predetermined print data. Accordingly, depending on the print data of the respective dot forming nozzles, ink may be applied to the recording substrate. After passing across the print line, the recording substrate is advanced in accordance with the length of the subgroup in the forward feed direction. A printhead can then continue to make recordings during the subsequent return movement (bidirectional printing) or only when a new advancing movement of the printhead is effected (unidirectional printing).

Bidirectional printing improves print throughput and is therefore more efficient at a time to print standpoint than unidirectional printing. Unidirectional printing has been used to achieve high quality output in bidirectional capable printers. For example, occasionally print artifacts of bidirectional printing are undesirable in print outcome. The direction chosen for unidirectional printing on a bidirectional capable printer is often predetermined in firmware and/or based on throughput considerations or the proximity of the maintenance station. The assumption that either the left to right carrier direction or the right to left carrier direction will provide an equivalent level of print quality is often erroneous due to asymmetries present in the jetting behavior of the printhead. This problem is further complicated due to manufacturing variations in printheads. Typically, printheads have an optimum print direction that should be used for unidirectional printing to achieve the best quality. In the past, the print direction for unidirectional printing has been determined by the manufacturer in the firmware, and typically is based on a sampling of printheads at the time of manufacture rather than the actual individual printhead(s) in the specific printer. Accordingly, there is a need for a method for determining optimal unidirectional print direction in an ink jet printer.

Manufacturing variations contribute to the tendency of both mono and color printheads to show dot quality differences as a function of carrier direction. Satellite drops, as illustrated in FIG. 1, typically follow the mother drop, and they can land on the medium past the mother drop in the same direction of the carrier motion due to their inherently lower drop velocity. Asymmetrical satellite behavior is very common in manufactured ink jet printheads. The lack of satellite symmetry between left to right jetting versus right to left jetting makes achieving bidirectional dot alignment more challenging. Another difficulty is the lack of symmetry is not consistent from printhead to printhead or manufacture lot to manufacture lot, but inevitably can vary from printhead to printhead.

Satellite asymmetry can cause graininess of a print recording. Graininess in an image will be aggravated by the presence of satellite dots. When a printing system is optimized to achieve all the benefits of unidirectional printing, minimizing graininess should be a high priority. As such, there is a need for a method for determining the optimal direction of carrier travel in which a printhead exhibits the least tendency to generate unwanted satellites while recording an image.

SUMMARY OF THE INVENTION

The present invention comprises methods for determining the unidirectional print direction for optimal printing quality. More specifically, this invention relates to methods and printer apparatus for determining unidirectional print direction for optimal printing quality on ink jet printers capable of bidirectional printing.

One embodiment of the present invention is a method of determining unidirectional print direction for optimal printing quality on a ink jet printer capable of bidirectional printing. The method comprises: printing a first plurality of indicators on a recordable medium, wherein the first plurality of indicators are printed in a first direction; printing a second plurality of indicators on the recordable medium, wherein the second plurality of indicators are printed in a second direction opposite the first direction; determining an optimum print direction from the printed indicators; and setting in the printer the optimum print direction for unidirectional printing.

The present methods are advantageous for determining the unidirectional print direction for optimal printing quality on an ink jet printer capable of bidirectional printing.

BRIEF DESCRIPTION OF THE DRAWINGS

While the specification concludes of claims particularly pointing out and distinctly claiming the invention, it is believed the same will be better understood from the following description taken in conjunction with the accompanying drawings in which:

Figure 1:
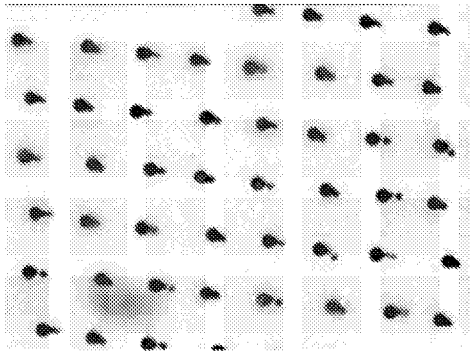
FIG. 1 depicts an exemplary illustration of satellite dot placement issues as a function of carrier direction.
Figure 1:
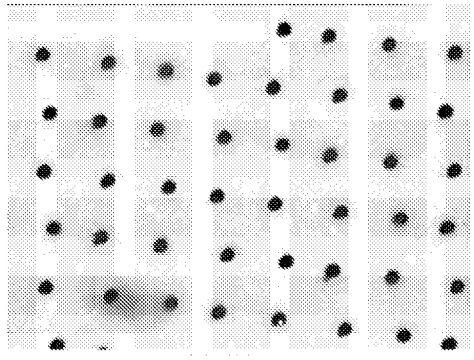

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE INVENTION

Reference will now be made in detail to various embodiments of the invention, examples of which are illustrated in the accompanying drawings, wherein like numerals indicate similar elements throughout the views.

Figure 2:
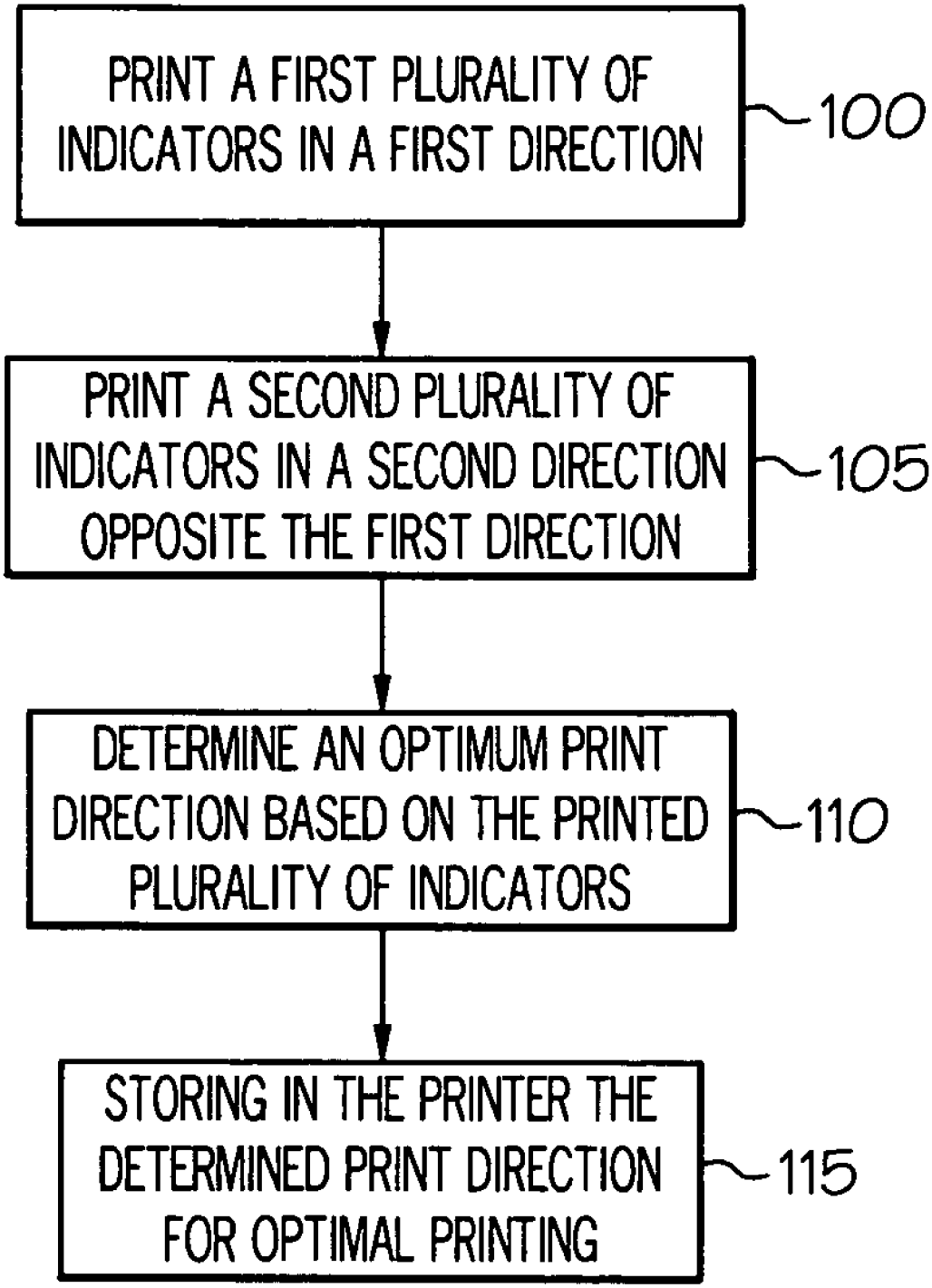
FIG. 2 depicts a flowchart of an exemplary method for determining unidirectional print direction for optimal printing quality according to a first embodiment of the present invention.

One embodiment of the present invention, as depicted in FIG. 2, is a method of determining unidirectional print direction for optimal print quality on an ink jet printer capable of bidirectional printing. The method comprises: printing a first plurality of indicators on a recordable medium, wherein the first plurality of indicators are printed in a first direction (100); printing a second plurality of indicators on the recordable medium, wherein the second plurality of indicators are printed in a second direction opposite the first direction (105); determining an optimum print direction based on the analysis of the printed indicators (110); and storing in the printer the determined optimum print direction for unidirectional printing (115).

In an exemplary embodiment, the first plurality of indicators and the second plurality of indicators each comprise one or more patches. These patches may comprise gray scale patches printed at predetermined gray scale levels. Exemplary gray scale levels of the indicators range between about 20% and about 60%. In one exemplary embodiment, a sequence of cyan-colored patches are printed at various levels of gray scale. Equal percentage coverage patches varying from about 20% to about 60% gray scale level are printed in both left to right and right to left carrier directions. As one skilled in the art will appreciate, any color ink may be utilized for printing the first and second plurality of patches.

In another exemplary embodiment of the present invention, the method further comprises scanning the plurality of first and second indicators with a sensor and comparing the first plurality of indicators with the second plurality of indicators. In one exemplary embodiment, the sensor comprises an optical sensor. Exemplary optical sensors include a reflectance sensor. A reflectance sensor may be, for example, a unitary optical sensor including at least one light source, such as a light emitting diode (LED), and at least one reflectance detector, such as a phototransistor. The reflectance detector is located on the same side of the sheet of print media as the light source. The operation of such sensors is well known in the art, and thus, will be discussed herein to the extent necessary to relate the operation of the reflectance sensor to the operation of the present invention. For example, the LED of reflectance sensor directs light at a predefined angle onto a surface to be read, such as the surface of the sheet of print media, and at least a portion of light reflected from the surface is received by the reflectance detector of the reflectance sensor. The intensity of the reflected light received by the reflectance detector varies with the reflectance, i.e. reflectivity, of the surface. The light received by the reflectance detector of the reflectance sensor is converted to an electrical signal by the reflectance detector of reflectance sensor, and is supplied to a controller for further processing. The signal generated by the reflectance detector corresponds to the reflectance of the surface scanned by the reflectance sensor. Thus, as used herein, the term "reflectance" refers to the intensity of the light reflected from the sheet of print media scanned by a reflectance sensor, which may be used in accordance with the present invention in providing unidirectional print direction determination.

In one exemplary embodiment, the optical sensor can be used to scan over the plurality of indicators and a comparison is made between equal gray level patches printed in each direction. Satellites present, either discrete or manifested with tails on the mother dot, in either direction will increase the percent coverage within the patch. Two identical gray scale level image data patches printed in two opposing directions will reflect different levels of light if one of the directions has satellite dots as well as mother dots covering the medium. If satellites are present, the patch will show a reduced reflectance level when compared to the reflectance level measured on patches printed in the opposite direction without satellites present. To minimize graininess when printing unidirectionally, the optimum print direction is the direction with the highest reflectance based on equal gray level patches printed in both directions.

In another embodiment, if the first and second plurality of printed patches are indistinguishable from one another, such as the reflectance values for equal gray scale level patches printed both right to left and left to right measure to be the same value within a predetermined tolerance, the printhead will be determined to not have a preferred direction for optimal print quality. As such, the printhead has symmetrical satellite generation. In this case with symmetrical satellite generation, other various factors can be utilized to determine optimum print direction, such as location of the maintenance station, etc.

Figure 3:
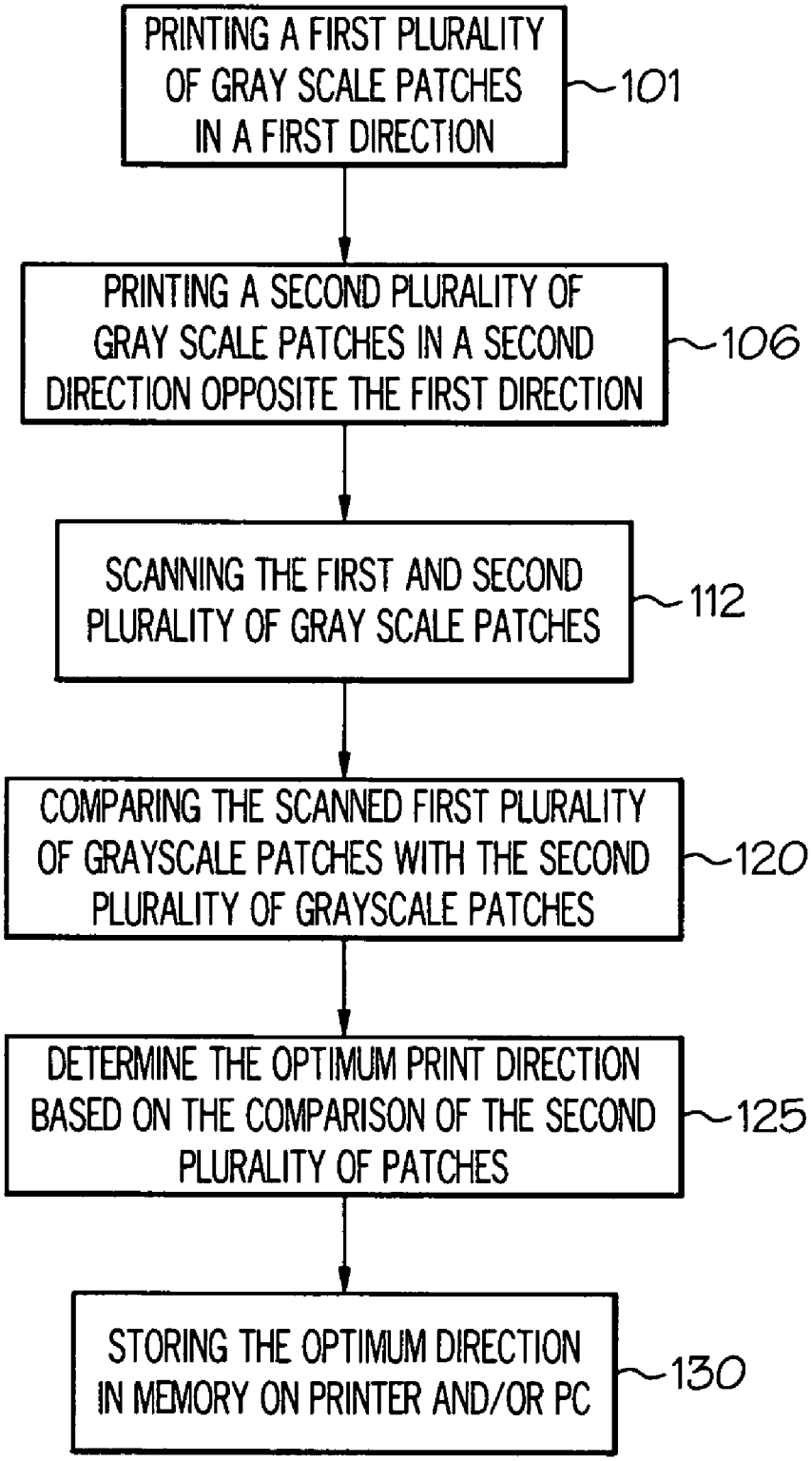
FIG. 3 depicts a flowchart of an exemplary method for determining unidirectional print direction for optimal printing quality according to a second embodiment of the present invention.

Yet another embodiment of the present invention, as depicted in FIG. 3, is a method of determining unidirectional print direction for optimal print quality on an ink jet printer capable of bidirectional printing. The method comprises: printing a first plurality of gray scale patches on a recordable medium, wherein the first plurality of patches are printed in a first direction (101); printing a second plurality of gray scale on the recordable medium, wherein the second plurality of patched are printed in a second direction opposite the first direction (106); scanning the first and second plurality of gray scale patches with an optical sensor (112); comparing the scanned first plurality of gray scale patches with the second plurality of gray scale patches (120); determining the optimum print direction based on the comparison of the scanned plurality of gray scale patches (125); and storing the optimum print direction in a computer readable storage medium on the printer and/or computer (130).

Another embodiment of the present invention is a method for determining unidirectional print direction for optimal print quality on an ink jet printer capable of bidirectional printing. In this method, the printer prints, utilizing bidirectional printing, at least two vertical lines on a recording substrate, wherein one of the vertical lines is only recorded on the substrate while the printhead is in a right to left motion, whereas at least one of the other vertical lines is only recorded on the substrate when the printhead is in a left to right motion. The vertical lines to be recorded are at a predetermined number of pixels in width and should be equal to one another. After being recorded, the vertical lines can be compared to one another to aid in determining the optimum print direction. For example in one embodiment, a user may visually scan the vertical lines for potential differences in width of the vertical lines. In this embodiment, an increased width in one of the vertical lines, would typically indicate the presence of satellite asymmetries resulting in that vertical line being wider than desired. In a similar embodiment, a sensor or imaging device, such as a camera, scanner, etc. can be utilized to analyze the two vertical lines to determine the optimum print direction. Such analysis could compare the width, reflectance value or other factors known to those skilled in the art.

Another embodiment of the present invention is a storage medium with machine-readable computer program code for determining unidirectional print direction for optimal quality on an ink jet printer, the storage medium includes instructions for causing a computer or printer controller to control a printer to implement a method, comprising: printing a first plurality of indicators on a recordable medium, wherein the first plurality of indicators are printed in a first direction; printing a second plurality of indicators on the recordable medium, wherein the second plurality of indicators are printed in a second direction opposite the first direction; determining an optimal print direction from the printed indicators; and storing in the computer or the controller for the printer the optimal print direction for unidirectional printing.

Another embodiment of the present invention is a computer data signal embodied in a carrier wave and representing sequences of instructions which, when executed by a processor, determine unidirectional print direction for better optimal quality on an ink jet printer, the signal comprising instructions for: printing a first plurality of indicators on a recordable medium, wherein the first plurality of indicators are printed in a first direction; printing a second plurality of indicators on the recordable medium, wherein the second plurality of indicators are printed in a second direction opposite the first direction; determining an optimal print direction from the printed indicators; and storing in the computer or the controller for the printer the optimal print direction for unidirectional printing.

Figure 4:
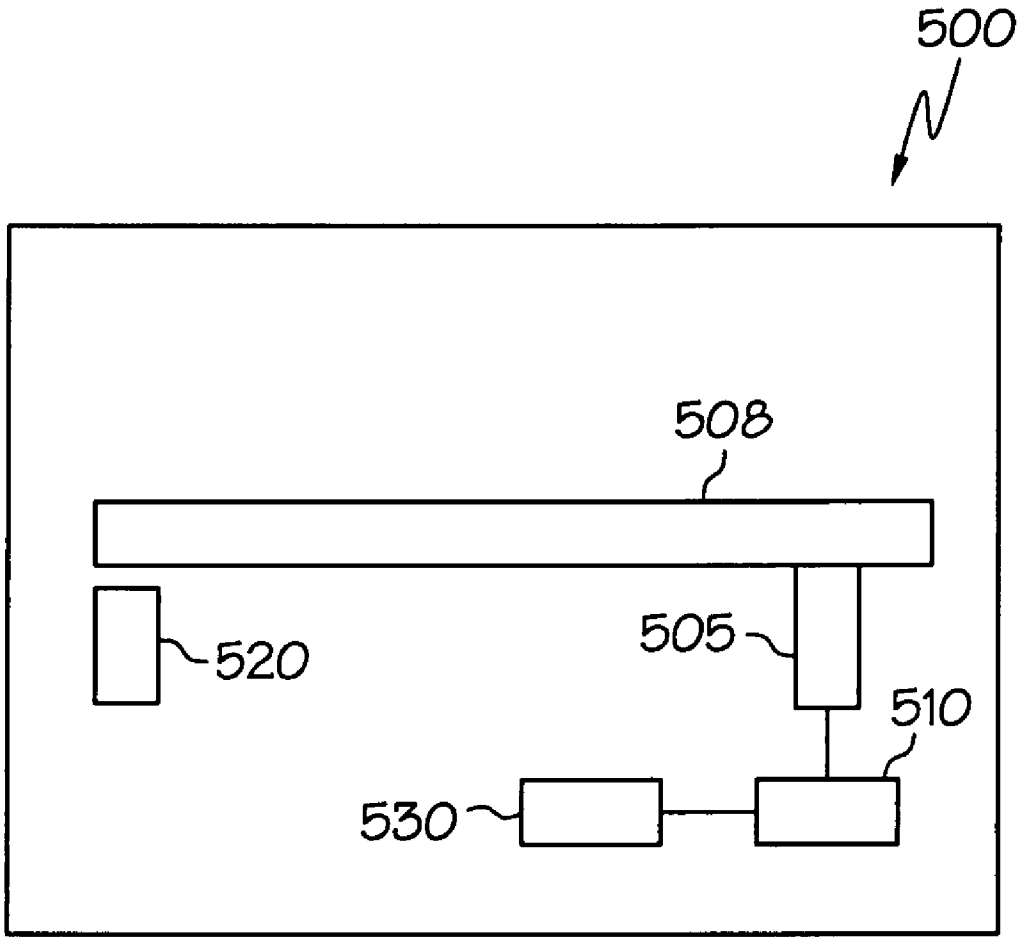
FIG. 4 is a schematic illustration of an exemplary printer apparatus according to a third embodiment of the present invention.

Yet another embodiment of the present invention, as depicted in FIG. 4, is an ink jet printer 500 having the capability of bidirectional printing and the ability to determine unidirectional print direction for optimal print quality. The printer 500 comprises: a printhead 505 comprised of dot forming nozzles for projecting ink onto a printing area on a recording medium, wherein the printhead 505 is mounted on a carriage assembly 508; a control unit 510, wherein the control unit 510 is adapted to control movement of the printhead 505 along the carriage assembly 508 and projection of ink from the printhead 505; a sensor 520 wherein the sensor 520 is adapted to analyze one or more print characteristics of a recorded image; and a computer recordable storage medium 530, wherein the computer readable storage medium 530 comprises executable instructions for causing the control unit 510 to implement a method, comprising: printing a first plurality of gray scale patches on a recordable medium, wherein the first plurality of patches are printed in a first direction; printing a second plurality of gray scale patches on the recordable medium, wherein the second plurality of patches are printed in a second direction opposite the first direction; scanning the first and second plurality of gray scale patches with the sensor 520; comparing the scanned first plurality of gray scale patches with the second plurality of gray scale patches; determining the optimum print direction based on the comparison of the scanned plurality of gray scale patches; and storing the optimum print direction in a computer readable storage medium on the printer and/or computer.

One skilled in the art will appreciate that the methods of the present invention may be stored in various locations utilized in printing systems. For example, the executable instructions for the method may be stored in the printer's firmware or computer readable storage medium included in the printer. Alternatively, the method may be stored in software on an attached personal computer or a remote computer/server connected to a network such as the Internet. Alternatively, the executable instructions for performing the method may be stored on removable computer readable storage medium, such as solid state memory including compact flash and the like, wherein the printer is adapted to read the executable instructions from the removable computer readable storage medium.

As one skilled in the art will appreciate, in one embodiment the present invention maybe practiced utilizing a single indicator in each carrier direction rather than a plurality of indicators. Multiple indicators in each carrier direction will typically increase the signal strength and level of confidence in determining the unidirectional print direction for optimal quality.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

I claim:

1. An ink jet printer having the capability of bidirectional printing and the ability to determine unidirectional print direction for optimal print quality, comprising:

a printhead comprised of dot forming nozzles for projecting ink onto a printing area on a recording medium, wherein the printhead is mounted on a carriage assembly;

a control unit, wherein the control unit is configured to control movement of the printhead along the carriage assembly and control projection of ink from the printhead;

a sensor, wherein the sensor is configured to analyze one or more print characteristics of a recorded image; and a first computer readable storage medium, wherein the first computer readable storage medium comprises executable instructions for causing the control unit to:

print a first plurality of gray scale patches on a recordable medium, wherein the first plurality of patches are printed in a first direction;

print a second plurality of gray scale patches on the recordable medium, wherein the second plurality of patches are printed in a second direction opposite the first direction;

scan the first and second plurality of gray scale patches with the sensor;

compare the scanned first plurality of gray scale patches with the second plurality of gray scale patches;

determine the optimum unidirectional print direction of the bidirectional capable printer based on the comparison of the scanned plurality of gray scale patches; and store the optimum print direction in the first or another computer readable storage medium on the printer and/or computer.

2. A method of determining unidirectional print direction for optimal print quality on an inkjet printer capable of bidirectional printing, comprising:

printing a first plurality of indicators on a recordable medium, wherein the first plurality of indicators are printed in a first direction;

printing a second plurality of indicators on the recordable medium, wherein the second plurality of indicators are printed in a second direction opposite the first direction;

scanning the plurality of first and second indicators with an optical sensor;

determining a reflectance value for each of the indicators;

comparing the determined reflectance value with a predetermined reflectance value for each of the indicators;

determining an optimum unidirectional print direction of the bidirectional capable printer from the printed indicators; and storing in the printer the optimum print direction for unidirectional printing.

3. A method of determining unidirectional print direction for optimal print quality on an inkjet printer capable of bidirectional printing, comprising:

printing a first plurality of indicators on a recordable medium, wherein the first plurality of indicators are printed in a first direction;

printing a second plurality of indicators on the recordable medium, wherein the second plurality of indicators are printed in a second direction opposite the first direction, wherein the first plurality of indicators and the second plurality of indicators each comprise one or more vertical lines;

determining an optimum unidirectional print direction of the bidirectional capable printer from the printed indicators; and storing in the printer the optimum print direction for unidirectional printing; and wherein determining an optimum print direction comprises:

scanning the plurality of first and second indicators with an imaging device;

measuring a width of the one or more vertical lines utilizing the imaging device; comparing the widths of the one or more lines of the first plurality of indicators with the widths of the one or more lines of the second plurality of indicators.

* * * * *